US010273649B2

(12) United States Patent
Lonero

(10) Patent No.: US 10,273,649 B2
(45) Date of Patent: Apr. 30, 2019

(54) MODULAR BLOCK RETAINING WALL SYSTEM

(71) Applicant: Richard Paul Lonero, Trafford, PA (US)

(72) Inventor: Richard Paul Lonero, Trafford, PA (US)

( * ) Notice: Subject to any disclaimer, the term of this patent is extended or adjusted under 35 U.S.C. 154(b) by 0 days.

(21) Appl. No.: 15/732,118

(22) Filed: Sep. 20, 2017

(65) Prior Publication Data

US 2018/0100283 A1 Apr. 12, 2018

Related U.S. Application Data

(60) Provisional application No. 62/496,311, filed on Oct. 12, 2016.

(51) Int. Cl.

| | |
|---|---|
| ***E02D 29/02*** | (2006.01) |
| ***E04C 1/39*** | (2006.01) |
| ***E04H 17/14*** | (2006.01) |

(52) U.S. Cl.

CPC ..... *E02D 29/0266* (2013.01); *E02D 29/025* (2013.01); *E04C 1/395* (2013.01); *E04H 17/1404* (2013.01); *E02D 29/0233* (2013.01); *E02D 2200/1657* (2013.01); *E02D 2200/1692* (2013.01); *E02D 2250/0023* (2013.01); *E02D 2300/002* (2013.01)

(58) Field of Classification Search

CPC ..... E02D 29/0266; E02D 29/025; E02D 2200/1657; E02D 2200/1692; E02D 29/0233; E02D 2300/002; E02D 2250/0023; E04H 17/1404; E04C 1/395

See application file for complete search history.

(56) References Cited

U.S. PATENT DOCUMENTS

| | | | | |
|---|---|---|---|---|
| 2,888,779 A * | 6/1959 | Hostetter | A01G 9/28 47/33 |
| 2,942,115 A * | 6/1960 | O'Connell | G21F 3/04 250/517.1 |
| 4,914,876 A * | 4/1990 | Forsberg | E02D 29/025 405/284 |
| 4,996,813 A * | 3/1991 | Kliethermes, Jr. | E04C 1/395 52/592.1 |

(Continued)

FOREIGN PATENT DOCUMENTS

| | | | |
|---|---|---|---|
| GB | 2215749 A * | 9/1989 | E04B 2/06 |

*Primary Examiner* — Adriana Figueroa

(74) *Attorney, Agent, or Firm* — F. Brice Faller

(57) ABSTRACT

A system for building a wall includes a plurality of blocks and a plurality of connectors for aligning the blocks in successive courses. Each block has opposing first and second surfaces bounded by opposing front and rear faces and opposing end faces, the first and second surfaces being profiled with respective first and second rectilinear channels extending parallel to the front and rear faces. Each connector has first and second portions profiled for reception in respective first and second channels, the first portion being profiled to slide but not rotate in the first channel, the second portion being profiled to slide and rotate in the second channel. The second portion is offset from the first portion so that two different orientations of two blocks placed against each other are possible. The blocks preferably have a trapezoidal shape cut with only straight cuts to facilitate using natural stone.

18 Claims, 10 Drawing Sheets

(56) References Cited

U.S. PATENT DOCUMENTS

D319,885 S * 9/1991 Blomquist ..... D25/113
D321,060 S * 10/1991 Blomquist ..... D25/118
5,248,226 A * 9/1993 Risi ..... E02D 29/025 405/272
5,252,017 A * 10/1993 Hodel ..... E02D 29/025 403/292
D341,215 S * 11/1993 Blomquist ..... D25/118
5,282,700 A * 2/1994 Rodrique ..... E02D 29/025 405/284
5,294,216 A * 3/1994 Sievert ..... B28B 7/0097 405/262
5,505,034 A * 4/1996 Dueck ..... E02D 29/025 405/286
5,595,460 A * 1/1997 Miller ..... E02D 29/0225 405/284
5,619,835 A * 4/1997 Bailey, II ..... E02D 29/0241 405/286
5,816,749 A * 10/1998 Bailey, II ..... E02D 29/0241 405/284
6,447,213 B1 * 9/2002 MacDonald ..... E02D 29/0266 405/284
6,851,235 B2 * 2/2005 Baldwin ..... E04B 2/42 52/309.12
7,290,377 B2 * 11/2007 Dupuis ..... E04C 1/395 52/564
7,328,535 B1 * 2/2008 Correia ..... E02D 29/025 405/284
7,448,830 B2 * 11/2008 MacDonald ..... E02D 29/0225 405/284
7,971,407 B2 * 7/2011 MacDonald ..... E04C 1/395 52/379
8,240,105 B2 * 8/2012 Dueck ..... E02D 29/0241 405/284
D685,502 S * 7/2013 MacDonald ..... D25/113
8,667,759 B2 * 3/2014 Hammer ..... E04C 1/395 52/575
9,057,171 B2 * 6/2015 Ferraiolo ..... E02D 29/025
9,725,900 B2 * 8/2017 Correia ..... E04C 1/00
2002/0001509 A1 * 1/2002 Hong ..... E02D 29/025 405/286
2003/0074856 A1 * 4/2003 Hammer ..... E02D 29/025 52/604
2004/0191434 A1 * 9/2004 Correia ..... E04B 2/08 428/34.1
2010/0018146 A1 * 1/2010 Aube ..... E02D 29/0233 52/483.1

* cited by examiner

MODULAR BLOCK RETAINING WALL SYSTEM

FIELD OF THE INVENTION

The invention relates to a modular retaining wall system of the type utilizing blocks having channels that receive connectors for aligning and fixing blocks in successive courses in a number of orientations, and further provide means for attaching a soil reinforcing material such as a geogrid.

DESCRIPTION OF THE RELATED ART

Walls made of cut stone that is dry stacked, i.e. built without the use of mortar, have been known since ancient times; the Great Wall of China was built in the first millennium BC. Stone walls may be arranged in vertically aligned courses of stones placed end-to-end in rows, or arranged in successive courses that are set back to form a sloped wall for retaining soil or other filling behind the wall.

In recent years, segmental concrete retaining wall units which are dry stacked have become a widely accepted product for the construction of retaining walls. Kiltie Corporation markets its pre-fabricated concrete blocks under the trade name Versa-Lok® and has numerous design patents, e.g. U.S. D319,885, D321,060, and D341,215. Each block is cast with channels or slots and holes that receive pins therethrough to position it with respect to blocks in another course. Keystone Retaining Wall Systems also manufactures modular concrete blocks having holes that receive pins to align adjacent blocks. See, e.g., U.S. Pat. No. 7,971,407 and U.S. D685,502.

The above blocks have a substantially trapezoidal shape. This shape is popular because blocks can be arranged to form vertical and setback retaining walls, as well as freestanding walls, which are either straight or curved. For purposes of the present application, a trapezoidal block will be understood as one having parallel first and second oppositely facing trapezoidal surfaces (top and bottom surfaces), parallel oppositely facing front and rear faces of unequal length extending between the trapezoidal surfaces, and first and second oppositely facing end faces of equal length extending between the trapezoidal surfaces and converging from the front face toward the rear face.

Dueck U.S. Pat. No. 8,240,105 discloses a trapezoidal concrete block having a central cavity to reduce weight, anchor holes extending between the top and bottom surfaces, and a channel in the bottom surface parallel to front face. Connectors each have a bottom portion received in a respective anchor hole so that the connector can rotate, and a top portion received in a channel so that so that blocks in adjacent courses can be placed flushly against each other. The connectors also serve to anchor a geosynthetic grid extending into the soil being retained behind the wall.

Segmental concrete retaining wall units can have other shapes. Forsberg U.S. Pat. No. 4,914,876 (Keystone) discloses a block having a body forming a convex front face, a neck, and a head forming the rear face; blocks are connected by pins received through holes in the body. This patent also describes the use of geogrids anchored to the pins to stabilize the wall. Sievert U.S. Pat. No. 5,294,216 discloses an irregular trapezoid where the side faces have parallel front portions; this patent also details manufacture using a block molding machine. Kliethermes U.S. Pat. No. 4,996,813 discloses a concrete block having parallel front and rear faces, a concave end face formed by three planar surfaces, and an opposing convex end face formed by three planar surfaces. Each convex end face can be received in an adjacent concave end face in three different orientations. Blocks are connected by pins or cables therethrough; channels in the top surfaces serve to anchor a geogrid.

Miller U.S. Pat. No. 5,595,460 (Tensar Corporation) discloses a concrete block having channels provided in opposing top and bottom surfaces parallel to the front face. An elongated asymmetric connector has a row of toothed fingers that are forced into the top channel in an interference fit in one of two orientations, and tabs that are received in the bottom channel of the next course loosely. Since the central axes of the tabs are offset from the central axes of the fingers, the walls may be either setback or vertical, depending on the orientation of the connector. Bailey U.S. Pat. No. 5,619,835 (Tensar) discloses a similar concrete block wherein the top and bottom channels are connected by a tapered opening that facilitates manufacture using a tapered core during the molding process. Bailey also discloses molding a double block which is split along a groove to form front faces that simulate natural stone.

Concrete wall blocks have gained popularity because they are mass produced, and thus relatively inexpensive. Most are structurally sound and easy to install. However the durability of concrete, especially products produced on masonry block machines, has been an ongoing problem. Low compressive strength and high moisture absorption can lead to deterioration caused by freeze-thaw cycles, particularly when exposed to deicing agents. Improper cement hydration and poor aggregate selection can cause efflorescence, which significantly degrades the aesthetic appeal of the wall. UV rays and weathering can degrade iron oxide pigments added for color.

The overwhelming trend in the masonry block and wet-cast/precast industries has been simulated stone finishes for their retaining wall products. However the concrete products industry employs a considerably different manufacturing process than quarrying and cutting stone. Instead, quarried stone is crushed and mixed with significant amounts of cement, which uses considerable energy in production and freight, and also contributes to greenhouse gases and a host of other chemicals. All of this to simulate stone in its original form at the quarry.

From the standpoint of durability, aesthetics, and environmental friendliness, natural stone is preferable for retaining walls, but the cost of labor and limited design options often make this choice too costly. Adapting natural stone to a modular block system using automated fabrication would provide an existing and trained labor pool, saving enough to make this an affordable and environmentally sound choice for retaining wall construction. The stone could be quarried, cut into slabs, and shipped to shops for fabrication into usable products that are shipped to the ultimate customer.

SUMMARY OF THE INVENTION

A principal object of the invention is to provide a wall block system having modular blocks that can be configured in natural stone and assembled to form both vertical and setback retaining walls, as well as freestanding walls, in a number of different configurations.

This object is achieved with a block having opposed first (top) and second (bottom) surfaces with respective first and second channels, and a plurality of connectors for aligning the blocks, each connector having a first portion profiled for reception in a respective first channel and a second portion profiled for reception in a respective second channel so that two blocks can be placed against each other with a connector in between. The connectors can slide along the channels to achieve different degrees of bonding (overlap) between blocks in successive courses. The second portion is offset from the first portion so that different orientations of blocks with first and second surfaces placed against each other are possible.

Since the channels arc discrete grooves that do not extend through the blocks, they can be formed by a router, preserving the integrity of the stone. Since the channels are offset and the connectors are asymmetric, they may be used to form both freestanding and setback walls utilizing the same channels, simplifying block design. Since it is easy to change the line of the router, blocks can be custom-made to provide different degrees of setback.

According to a preferred embodiment, the first and second channels are formed parallel to each other and to the front and rear faces in a trapezoidal block of cut stone. This facilitates building a freestanding wall wherein the end faces are placed flushly against each other and the front and rear faces alternate in a given course. Vertical and setback retaining walls with the front faces all on the same side of the wall can also be constructed. In this case the connectors not only align the blocks, but can anchor a geogrid extending into the soil being retained. The geogrid stabilizes the blocks in the upper courses, where frictional force between mating surfaces may not be sufficient to stabilize the courses against soil loading.

Trapezoidal blocks are preferred because this shape can be achieved by cutting stone with a saw, with subsequent routing to form channels. However the inventive system is not limited to cut stone, but may be implemented by casting concrete. This opens the possibility of making blocks with shapes that cannot be achieved with straight cuts. For example, blocks with semicircular concave and convex end faces may be cast in concrete with channels according to the invention. Here too the assymmetric connectors would be used between courses.

The invention also relates to a method of a constructing a vertical or setback retaining wall using the wall blocks and connectors described above.

First, a leveling pad of dense base material or unreinforced concrete is placed, compacted and leveled. Second, the initial course of blocks is placed and leveled. Two alignment/connector devices are placed in the first or top channel of each block. Third, succeeding courses of the blocks are placed in a "half bond" pattern such that each block is centered over the two blocks below it. This is done by placing the blocks so that the second or bottom channels fit over connectors placed in the blocks in the course below. As each course is placed, connectors are placed in the blocks, the blocks are backfilled with drainage rock, and the area behind the course is backfilled and compacted until the wall reaches the desired height.

If wall height or loading conditions require, the wall may be constructed using reinforced earth techniques such as geogrid reinforcement. This is often desirable in upper courses where the friction force between mating surfaces is not sufficient to reinforce the wall against the loading of soil being retained. After placement of a course of blocks to the desired height, the geogrid material is placed so that the connectors in the blocks penetrate the apertures of the geogrid. The geogrid is then laid back into the area behind the wall and put under tension by pulling back and staking the geogrid. Backfill is placed and compacted over the geogrid, and the construction sequence continues as described above until another layer of geogrid is called for in the planned design.

The construction of a freestanding wall procedes in similar fashion, without backfilling and placement of a geogrid.

The invention further relates to a method of fabricating wall blocks in natural stone such as limestone, sandstone, metamorphic rock, or granite. It is generally provided in the form of quarry blocks with dimensions 8'×4'×4'. The quarry blocks are then cut into quarry slabs, approximately 8'×4'×6" thick. This is done at the quarry with either a large gantry saw or wire/belt saw.

The slabs are put through a conventional hydraulic stone splitter which produces rectangular blocks of stone 4' long× 9" wide×6" thick, however the width can be adjusted to provide different levels of internal stability for walls. An example of a stone splitter that can split a variety of stones is a Chris Cutter 3 manufactured by Cee-Jay Tool Company, Inc. of Windsor, Colo. A typical stone splitter exerts up to 140 tons of pressure on the slab to split it into uniform stone blocks. The machine's cutting edge consists of multiple chisels that adjust individually to the natural contours of the stone slabs. The individual chisels provide equal pressure so the stone is split in straight lines.

The 4' long blocks are then moved through a grinder, if necessary, to remove high and low areas on the top surface that create differential settlement and installation issues. The grinder is a conventional grinder and uses a plurality of matching diamond blades mounted on the same shaft traveling on a bridge, or fixed above the conveyed blocks.

The blocks are now processed through the second stage, wherein receiving channels are routed into the bottom of the rectangular block, the block is flipped, and setting channels are routed into the top of the block. This is accomplished using CNC capacity coupled with a standard motor and tooling capable of removal of the material for the channels. The equipment is produced with off-the-shelf components by companies such as Diamond Stone Technologies of Bedford, Ind. This can also be accomplished with a manual multitask machine for stone fabrication. One such model is a Fab King by Rye Corp of Knoxville, Tenn.

The long block is then conveyed to a meter saw to be cut into shorter blocks having the required trapezoidal shape. One such saw, the Model KM24, is available from Kalamazoo Industries, Inc.

The finished blocks are then conveyed to the palletizing robot that will pick and place three nested blocks at a time on a standard 4'×4' pallet. One such example of a palletizing robot is the R-2000 from Fanuc robotics. The robot is tooled with an off-the-shelf 4' long vacuum lifting tool.

The foregoing method does not require cement or any other hazardous chemicals; just water, which is preferably recycled.

DETAILED DESCRIPTION OF THE PREFERRED EMBODIMENTS

Figure 1A:
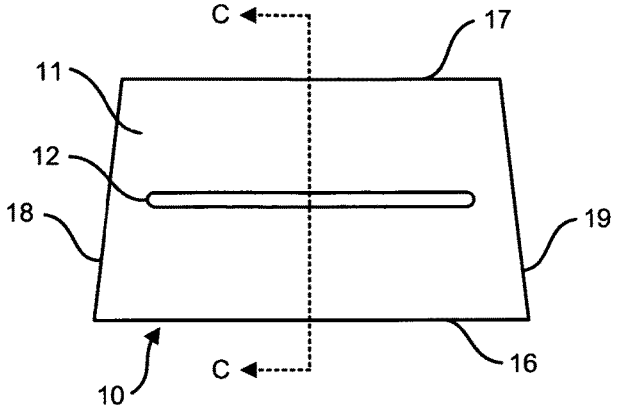
FIG. 1A is a plan view of the top surface of a block.
Figure 1B:
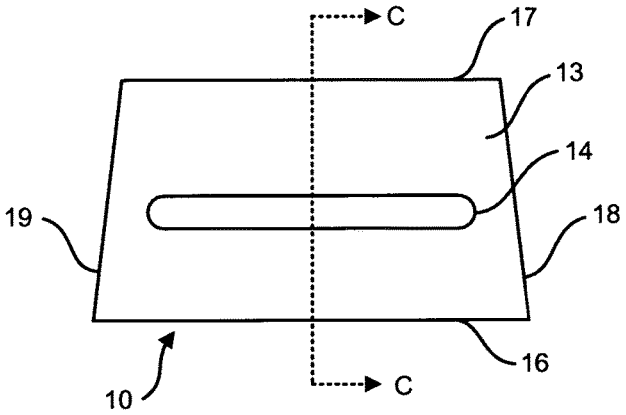
FIG. 1B is a plan view of the bottom surface of a block.
Figure 1C:
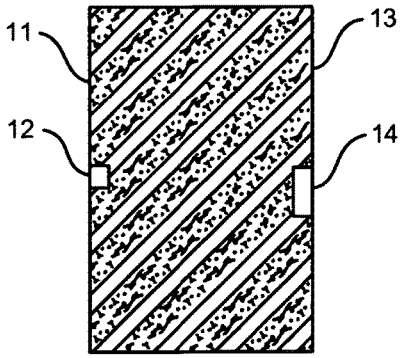
FIG. 1C a section view taken along the line C-C of FIGS. 1A and 1B.

FIGS. 1A-1C show a trapezoidal modular block 10 according to a first embodiment of the invention. Each block has parallel opposed top and bottom trapezoidal surfaces 11, 13 bounded by parallel opposed front and rear faces 16, 17 and converging end faces 18, 19. As shown in FIG. 1A, a top channel 12 is centered between front and rear faces 16, 17. FIG. 1B shows bottom surface 13 and bottom channel 14, which is wider than top channel 12 and is orthogonally across from top channel 12 but offset toward front face 16. The channels 12, 13 do not extend to the end faces 18, 19. FIG. 1C illustrates the depth of the top and bottom channels 12 and 14, which are profiled to receive respective first and second portions of a connector. The channels 12, 14 needn't be centered between the front and rear faces 16, 17; the operative factor in determining setback is the offset of the second channel 14 from the first channel 12.

Figure 2A:
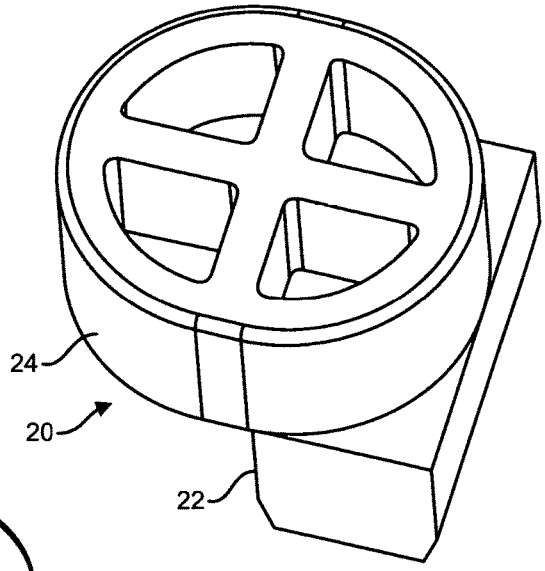
FIG. 2A is a top perspective of a connector.
Figure 2B:
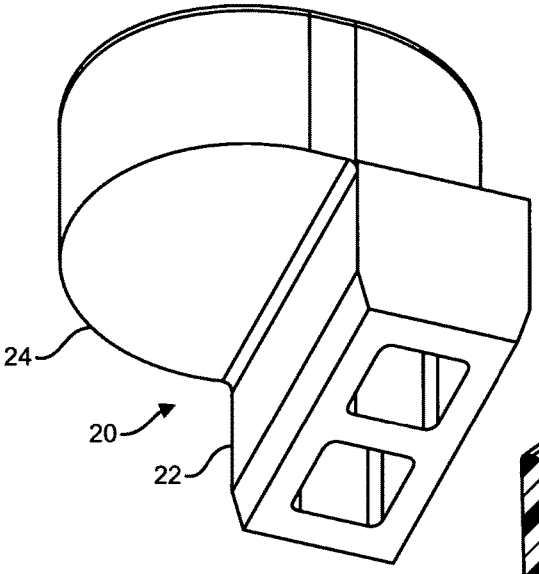
FIG. 2B is a bottom perspective of a connector.
Figure 2C:
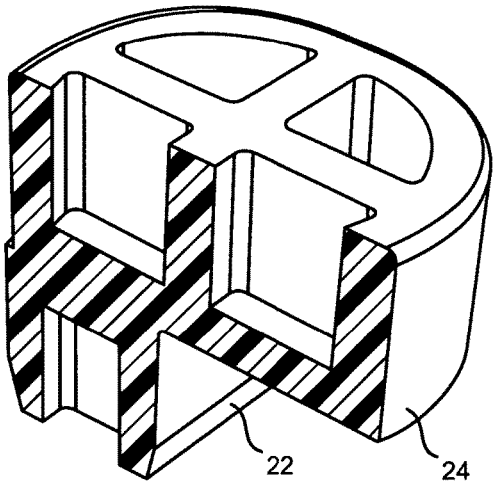
FIG. 2C is a sectioned perspective of a connector.

FIGS. 2A-2C show a preferred embodiment of connector 20 according to the invention, having a rectangular first portion 22 profiled for sliding reception in a top channel 12 of a block 10, and a cylindrical second portion 24 profiled for sliding and rotatable reception in a bottom channel 14 of the block. The connector 20 is preferably injection molded in nylon and has cavities that minimize the amount of material used in production. The second portion has a slightly oval cross-section for the same reason; it incorporates less material than a round cross-section, but still permits rotation.

Figure 3:
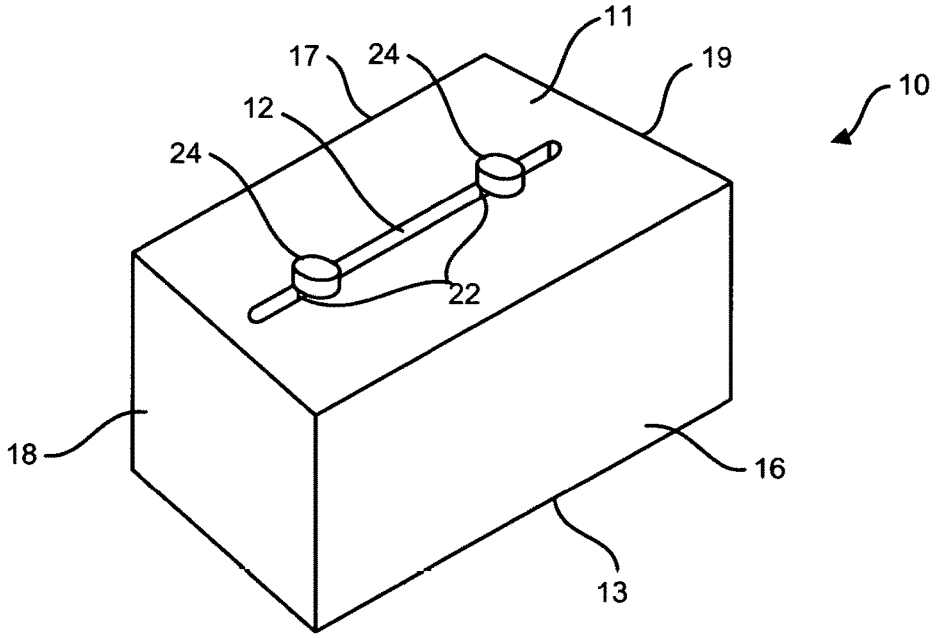
FIG. 3 is a perspective of a modular block with assymetric connectors having first portions received in the first channel so that their second portions extend toward the front face of the block.
Figure 4:
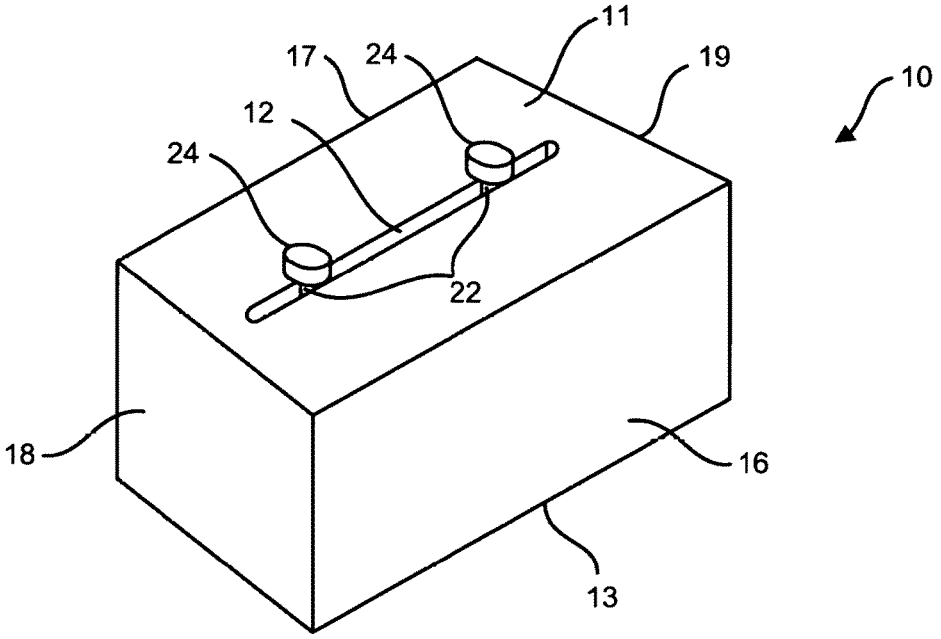
FIG. 4 is a perspective of a modular block with assymetric connectors having first portions received in the first channel so that their second portions extend toward the rear face of the block.
Figure 5B:
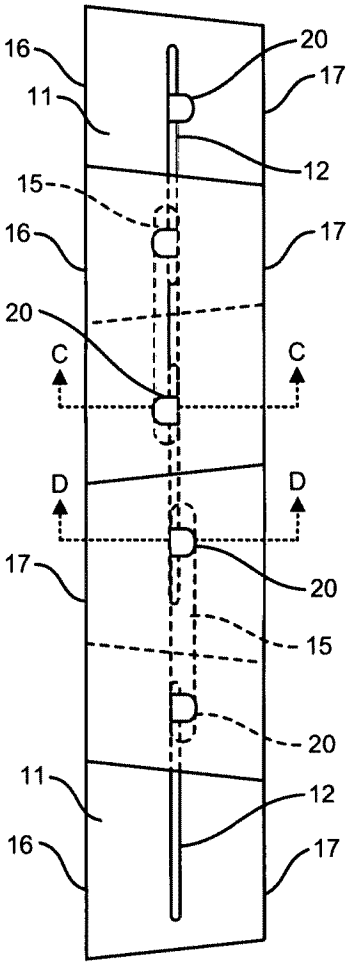
FIG. 5B is a plan view of the freestanding wall of FIG. 5A.
Figure 5A:
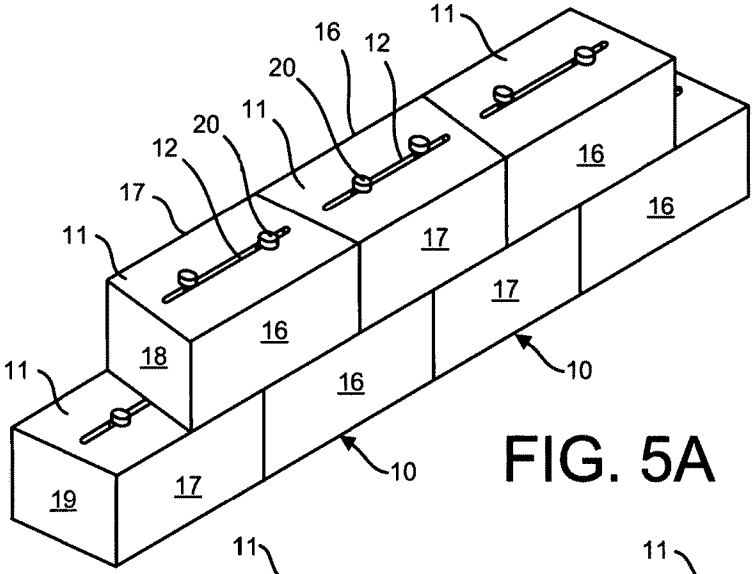
FIG. 5A is a perspective of a freestanding wall.
Figure 5D:
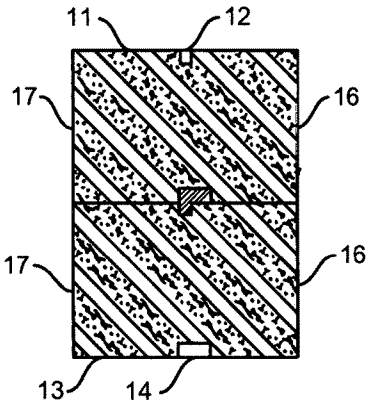
FIG. 5D is a section taken along line D-D of FIG. 5B.
Figure 5C:
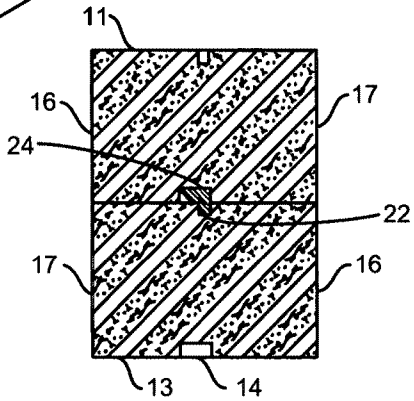
FIG. 5C is a section taken along line C-C of FIG. 5B.
Figure 6B:
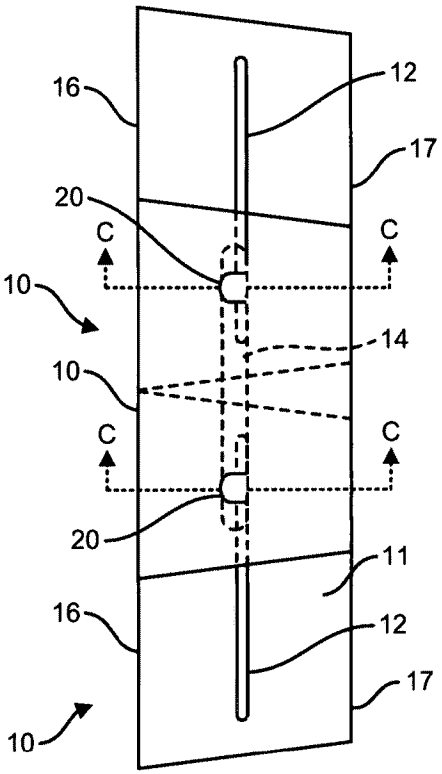
FIG. 6B is a plan view of the vertical retaining wall of FIG. 6A.
Figure 6C:
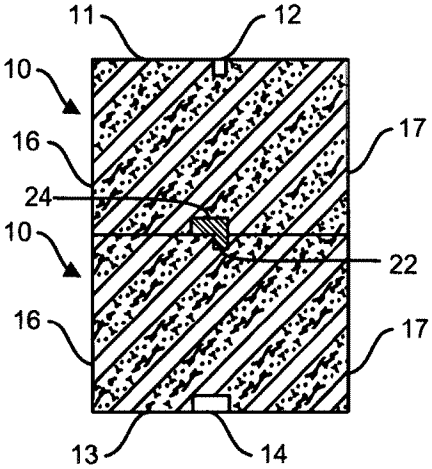
FIG. 6C is a section taken along line C-C of FIG. 6B.
Figure 6A:
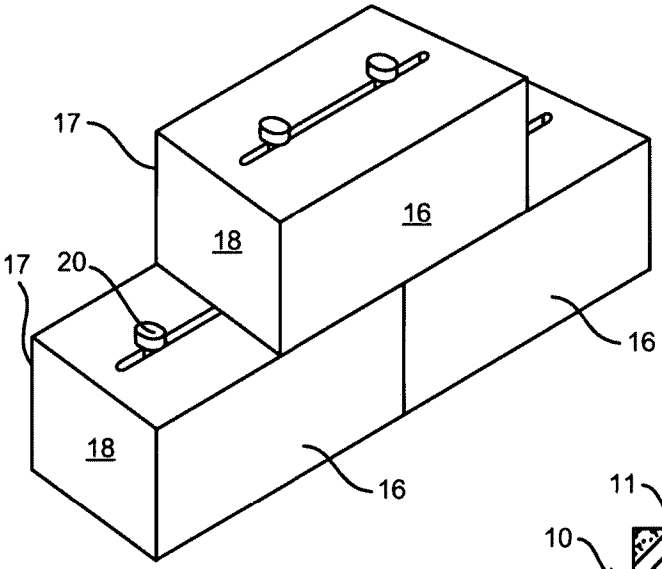
FIG. 6A is perspective of a vertical retaining wall.

FIGS. 3 and 4 show connectors 10 with their first portions 22 placed in the top channel 12, also referred to as the receiving channel. In FIG. 3 the second portions 24 are oriented toward the front face 16. Since the second channel 14 is offset toward the front face of the block, this orientation is suitable for a vertical wall (FIGS. 6A-6C). In FIG. 4 the second portions are oriented toward the rear face 17; this orientation is suitable for a setback wall (FIGS. 7A-7C).

FIGS. 5A-5D show a freestanding wall, so-called because it is constructed with front and rear faces 16, 17 alternating in each course so that no gaps are present. Connectors 20 are placed with opposed orientations in the top channel 12 of each block, with one second portion 24 received in the bottom channel 14 of one overlapping block 10, and the other second portion 24 received in the bottom channel 14 of another (oppositely facing) overlapping block 10.

FIGS. 6A-6C show a vertical retaining wall, so-called because it is constructed with front faces 16 all on one side in every course, so that gaps are present between all rear faces 17 in every course. These gaps will be filled with soil being retained behind the wall. All connectors 20 are oriented with their second portions 24 extending toward the front faces 16, so that the front faces 16 of successive courses are coplanar when the second portions 24 are received in the second channels 14 of the next course.

Figure 7B:
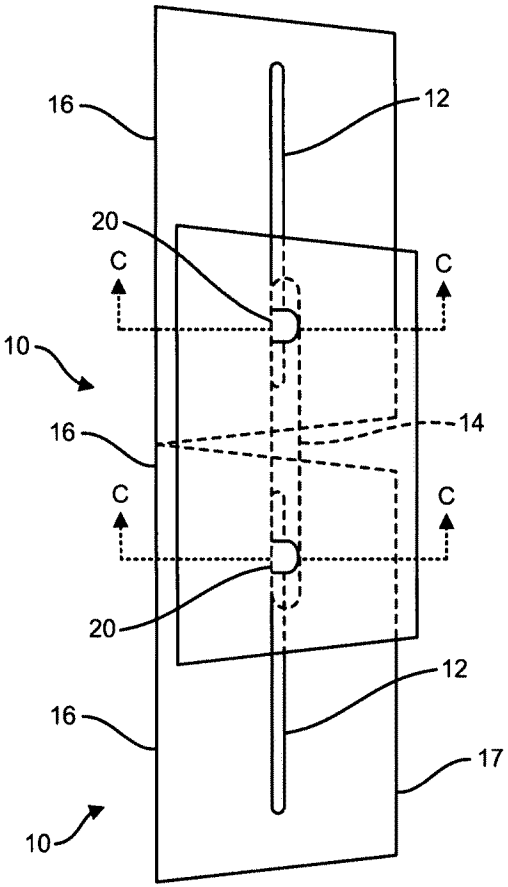
FIG. 7B is plan view of the setback retaining wall of FIG. 7A.
Figure 7C:
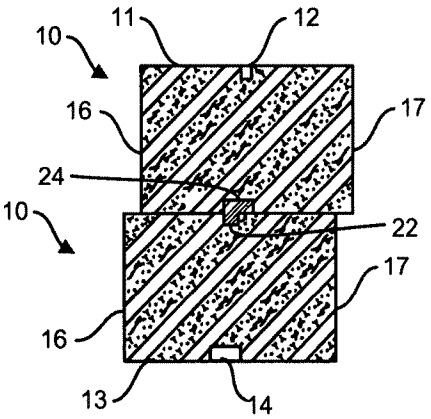
FIG. 7C is a section taken along line C-C of FIG. 7B.
Figure 7A:
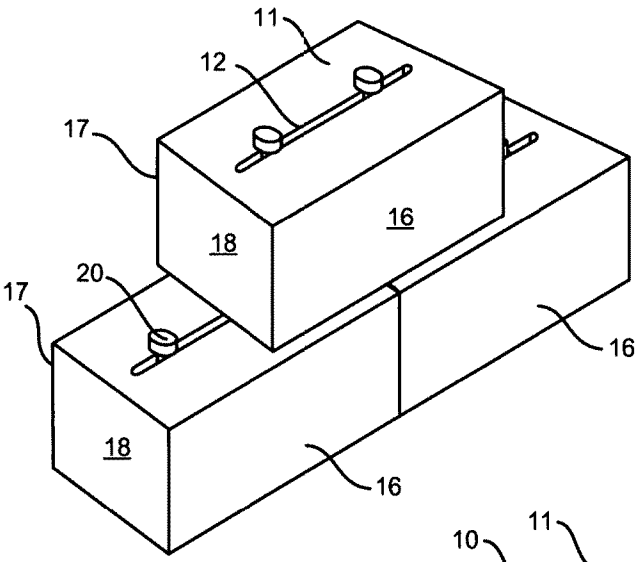
FIG. 7A is a perspective of a setback retaining wall.

FIGS. 7A-7C show a setback retaining wall, which is also constructed with front faces 16 all on one side in every course, so that gaps are present between all rear faces 17 in every course. However now all connectors 20 are oriented with their second portions extending 24 toward the rear faces 17, so that the front faces 16 of the upper course are set back from the front faces 17 of the lower course when the second portions 24 are received in the second channels 14 of the next course.

Figure 8:
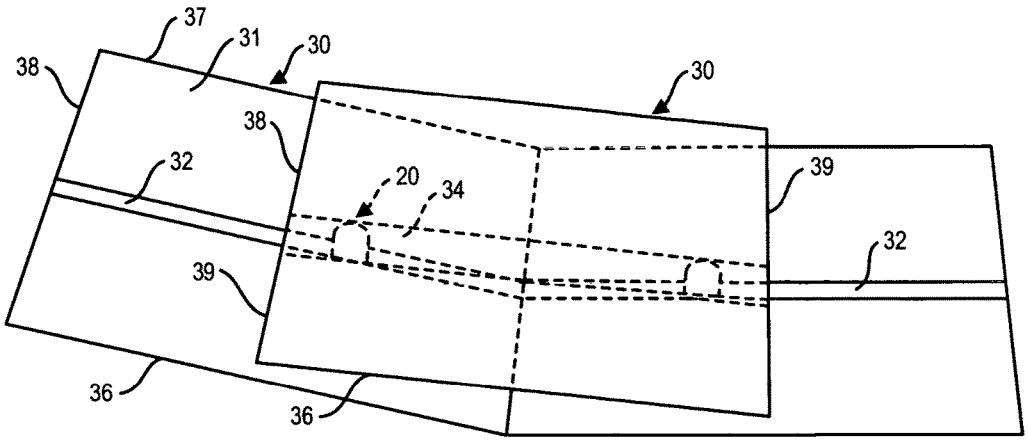
FIG. 8 is a plan view of a curved setback retaining wall with half bond courses.
Figure 9:
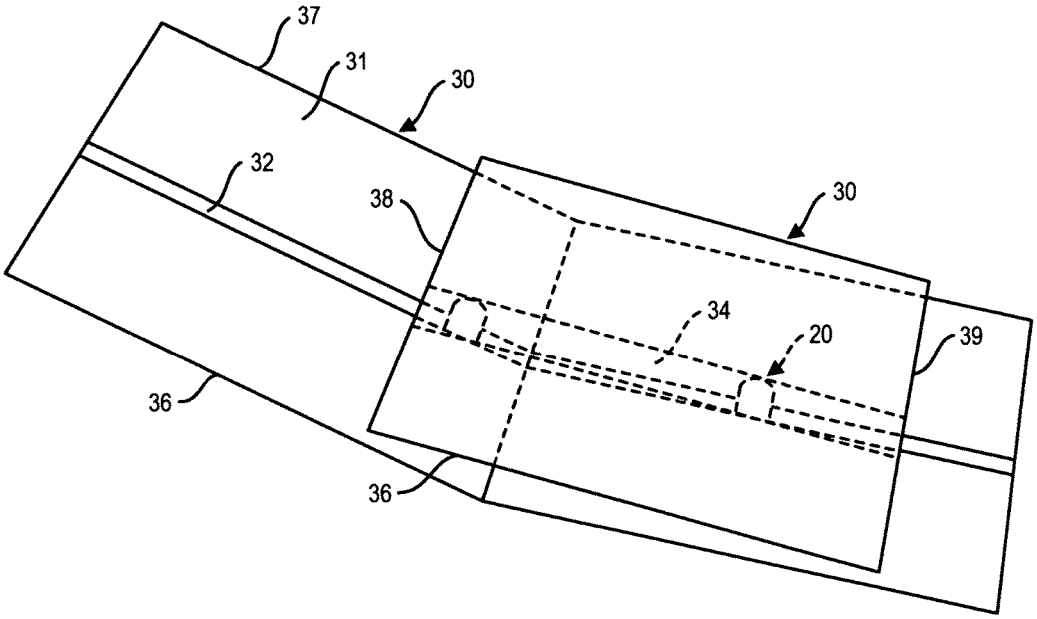
FIG. 9 is a plan view of a curved setback retaining wall with quarter bond courses.

FIGS. 8 and 9 illustrate a curved setback retaining wall, utilizing an alternative embodiment of modular block 30 having top and bottom trapezoidal surfaces 31, 33, front and rear faces 36, 37, and top and bottom channels 32, 34 extending to the end faces 38, 39, somewhat simplifying manufacture. The end faces 38, 39 are placed flushly together and connectors 20 are placed with their second portions 24 oriented toward the rear faces 37, with any desired amount of overlap between courses. The top channel in the top block and the bottom channels in the bottom blocks are not shown to avoid visual clutter, but are nevertheless present; all three blocks 30 in each figure are identical. FIG. 8 shows a "half bond" overlap, whereas FIG. 9 shows a "quarter bond" overlap. This may be continued to form an arc of any desired length, or alternated with straight sections of vertical retaining wall to form a bend. The blocks may also be placed to form a concave curve wherein the gaps between rear faces are larger than in a straight retaining wall.

From the foregoing it will be apparent that many permutations of the illustrated arrangements are possible. For example, a retaining wall may be constructed vertically for two courses, then setback for two courses, forming steeper "steps" in the wall.

Figure 10:
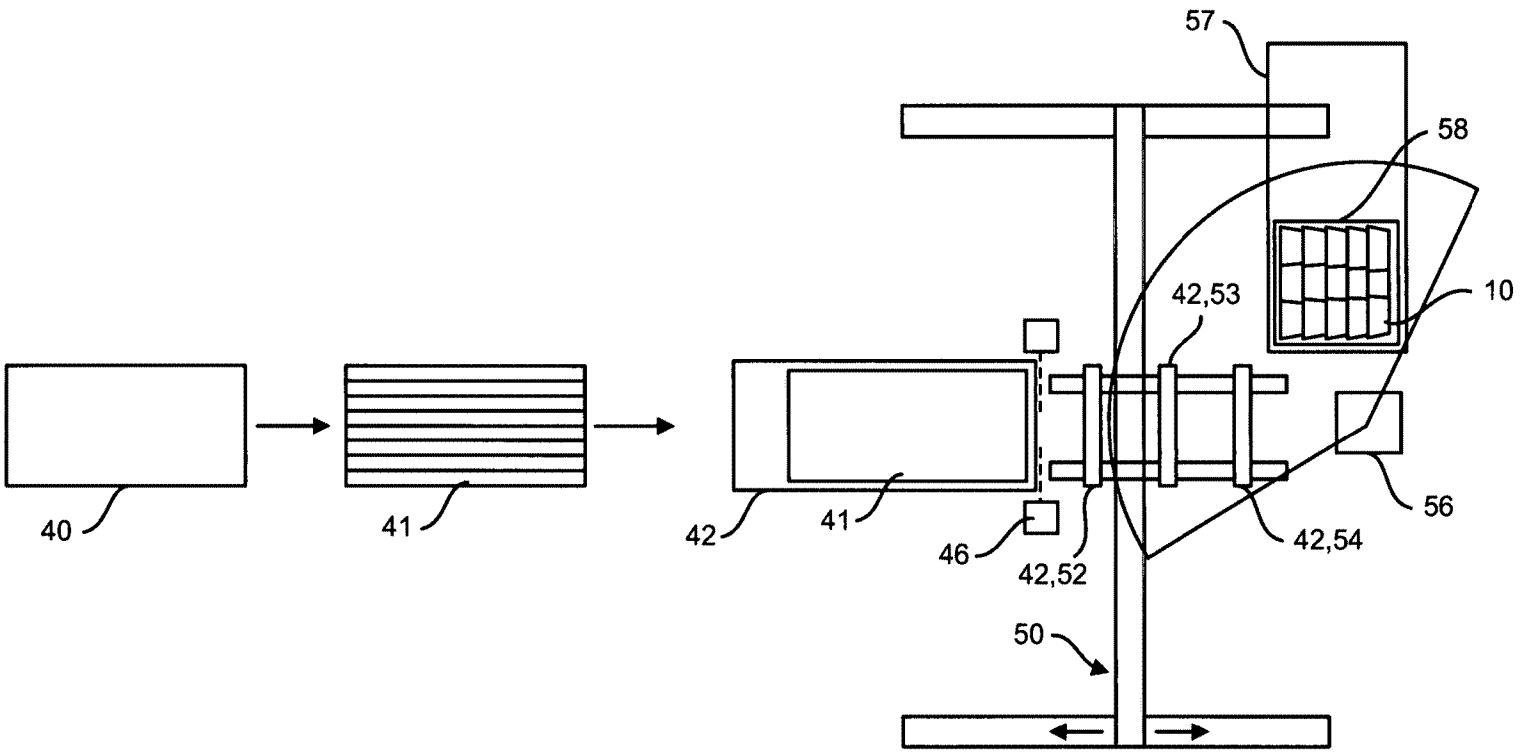
FIG. 10 is a schematic showing the steps in manufacturing the modular wall blocks from a quarry block.
Figure 11A:
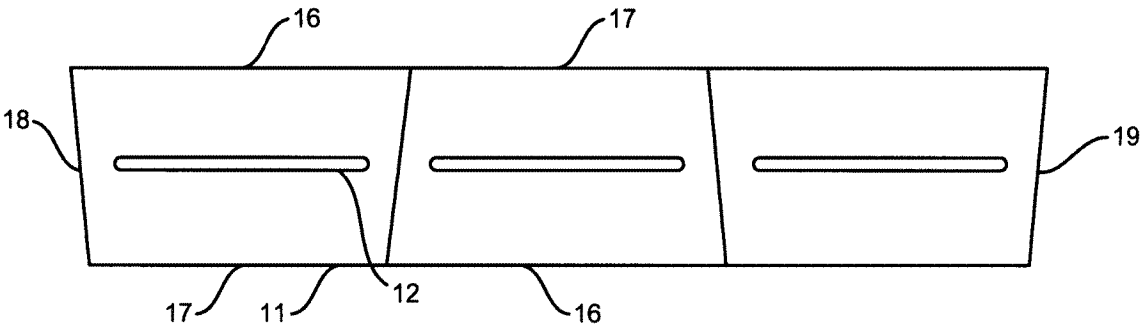
FIG. 11A is a top plan view of three blocks after the final cut.
Figure 11B:
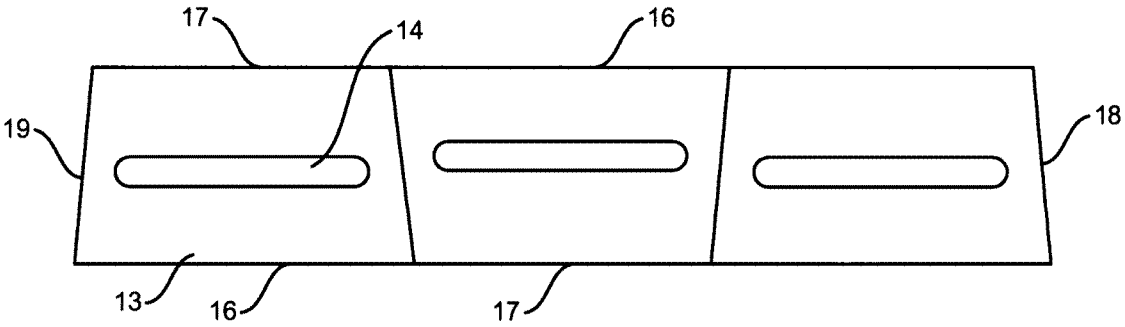
FIG. 11B is a bottom plan view of three blocks after the final cut.

FIG. 10 illustrates the manufacturing process. An 8'×4'×4'0 quarry block 40 is cut into 8'×4'×6" flat slabs 41 at the quarry for delivery to a local fabricating facility, where ensuing operations are performed. A flat slab 41 is loaded onto an infeed conveyor 44 that moves it to the hydraulic stone splitter 46, where it is split into 4'×9"×6" blocks 42. Each long block 42 is transferred by indexing conveyor 48 at loading station 52 and moved to cutting station 53, where a router on bridge 50 cuts second (bottom) channels 14 to provide the desired setback in a finished wall. The stick is then flipped at station 54 and returned to cutting station 53, where the first (top) channels 12 are routed. The blocks 42 are then cut by a meter saw on the bridge 50 to form angled end faces 18, 19 framing trapezoidal surfaces 11, 13; scraps from the ends simply fall into bins. As shown in FIGS. 11A and 11B, this yields a series of three nested blocks 10 in the final trapezoidal shape, with features numbered as in FIGS. 1A-1C. A robot 56 picks up the fully cut block 42 at station 54 and loads it onto a pallet 58 on outfeed conveyor 57; pick-up may be accomplished by a vacuum gripper of the type made by Schmalz, Inc. of Raleigh, N.C.

As will be apparent to one skilled in the art, many variations and substitutions in the manufacturing method are possible. For example the slabs 41 may be split at the quarry to form blocks 42, eliminating the need for a splitter at the local fabricator. A multi-function fully automated tool, for example a Sasso K600 5-axis CNC bridge saw, may be substituted for the router and miter saw on a bridge. The equipment chosen may ultimately depend on cost considerations dictated by the scale of production.

Figure 12A:
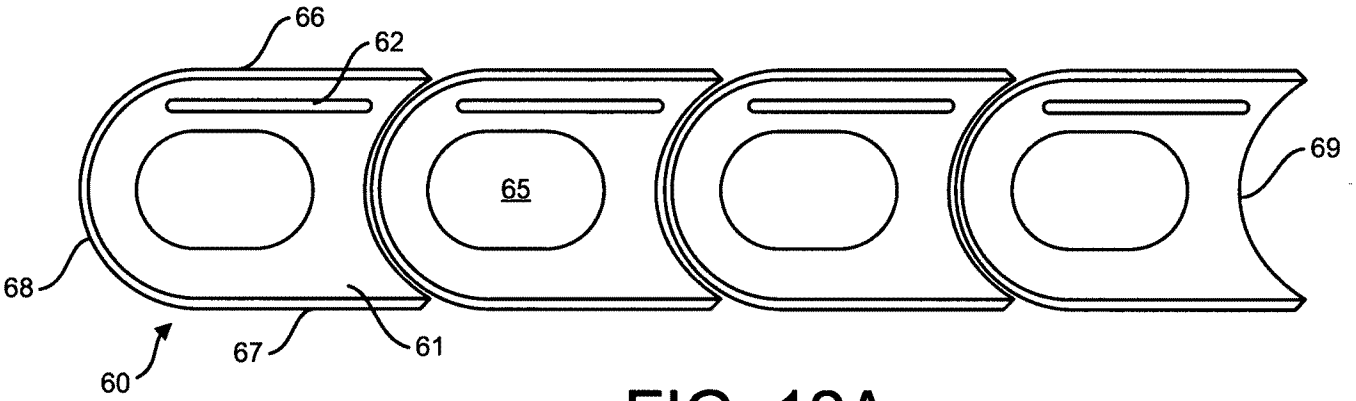
FIG. 12A is a top plan view of a series of molded concrete blocks according to an alternative embodiment.
Figure 12B:
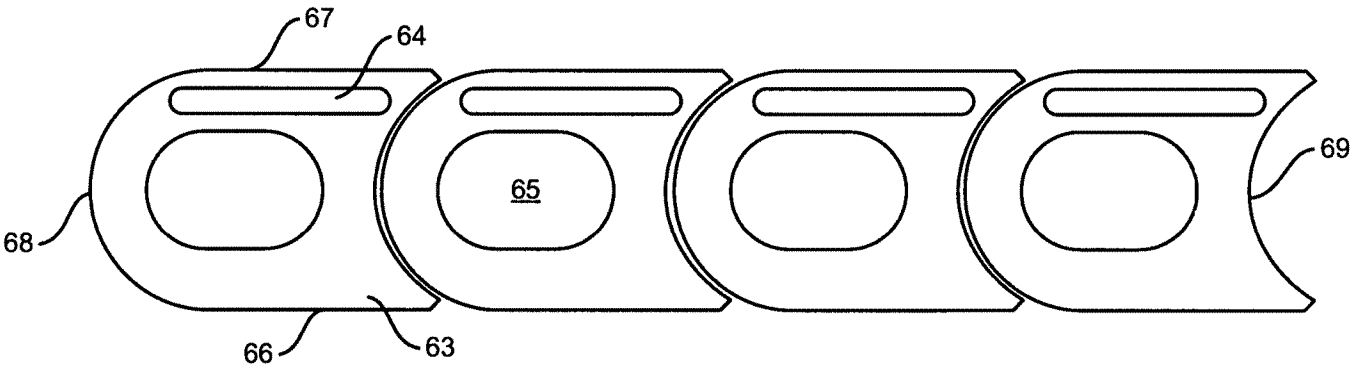
FIG. 12B is a bottom plan view of the blocks of FIG. 12A.

While the invention is focused on modular blocks that can be fabricated in stone, the inventive shape(s) can also be realized in concrete that is molded or cast. This opens the possibility of achieving shapes that cannot be realized with straight cuts. For example, as shown in FIGS. 12A and 12B, concrete blocks 60 can be formed with opposing convex and concave end faces 68, 69 with semicircular profiles so they can be placed together in series to form any desired curvature in a wall without gaps. As shown here, the top and bottom channels 62, 64 are formed in respective top and bottom surfaces 61, 63 adjacent to respective front and rear faces 66, 67 on opposite sides of a central cavity 65. When the channels in successive courses are aligned, their convex ends will point in opposite directions. If there were no central cavity, the channels could be formed in any desired position.

The foregoing is exemplary and not intended to limit the scope of the claims which follow.

What is claimed is:

1. A wall-building system comprising a plurality of blocks, each block having oppositely facing [substantially] planar first and second surfaces, oppositely facing front and rear faces, and oppositely facing end faces extending between said front and rear faces, said first and second surfaces being profiled with respective first and second rectilinear channels extending parallel to each other and to said front and rear faces, wherein said first and second channels are discrete grooves that do not extend through the block, said second channel being offset from said first channel toward one of said front and rear faces; and a plurality of connectors for aligning said blocks, each said connector having a first portion profiled for reception in a respective said first channel and a second portion profiled for reception in a respective said second channel so that two said blocks can be placed against each other with a connector therebetween, said first portion being profiled to slide but not rotate in said first channel, said second portion being profiled to slide and rotate in said second channel.

2. The system of claim 1 wherein said connectors are asymmetric, said second portion being offset from said first portion so that two opposing orientations of said second portion are possible when said first portion is in said first channel.

3. The system of claim 2 wherein said channels are arranged so that both the front faces and the rear faces of two said blocks placed against each other with said connector therebetween are coplanar in one of said orientations of said connector, whereby a vertical wall can be constructed.

4. The system of claim 2 wherein said first portion of said connector has a rectangular cross-section.

5. The system of claim 2 wherein said second portion of said connector has an oval cross-section.

6. The system of claim 1 wherein said first and second channels have different widths.

7. The system of claim 1 wherein said first and second surfaces are trapezoidal surfaces, said front and rear faces being parallel and of unequal length, said end faces being of equal length.

8. The system of claim 1 wherein said first channel is located midway between said front and rear faces.

9. The system of claim 1 wherein said blocks are configured in natural stone.

10. The system of claim 1 wherein said channels do not extend to said end faces.

11. A wall-building system comprising:

a plurality of blocks configured in natural stone, each block having oppositely facing planar first and second surfaces, oppositely facing front and rear faces, and oppositely facing end faces extending between said front and rear faces, said first and second surfaces being profiled with respective first and second rectilinear channels extending parallel to each other and to said front and rear faces, wherein said first and second channels are discrete grooves that do not extend through the block, said second channel being offset from said first channel toward one of said front and rear faces; and a plurality of connectors for aligning said blocks, each said connector having a first portion profiled for reception in a respective said first channel and a second portion profiled for reception in a respective said second channel so that two said blocks can be placed against each other with a connector therebetween, wherein said first portion is profiled to slide but not rotate in said first channel, and said second portion is profiled to slide and rotate in said second channel, said second portion being offset from said first portion so that two opposing orientations of said second portion are possible when said first portion is in said first channel.

12. The system of claim 11 wherein said channels are arranged so that the front faces of said two blocks placed against each other with a connector therebetween are coplanar in one orientation of said second portion, and are offset in the other orientation, whereby both vertical and setback walls can be constructed.

13. The system of claim 11 wherein said first and second channels have different widths.

14. The system of claim 11 wherein said first channel is located midway between said front and rear faces.

15. The system of claim 14 wherein second channel is offset toward said front face.

16. The system of claim 11 wherein said channels are formed by routing.

17. The system of claim 11 wherein said first and second surfaces are trapezoidal surfaces, said front and rear faces being parallel and of unequal length, said end faces being of equal length.

18. The system of claim 11 wherein said channels do not extend to said end faces.

* * * * *